US007815691B2

(12) United States Patent
Mavinkurve et al.

(10) Patent No.: US 7,815,691 B2
(45) Date of Patent: Oct. 19, 2010

(54) COMPOUND AND METHOD TO IMPROVE WRINKLE RESISTANCE IN FABRICS, AND FABRIC PROVIDED WITH SAID COMPOUND

(75) Inventors: Amar Ashok Mavinkurve, Singapore (SG); Sima Asvadi, Eindhoven (NL); Eduard Josephus Hultermans, Eindhoven (NL); Paul Anton Josef Ackermans, Eindhoven (NL); Rifat Ata Mustafa Hikmet, Eindhoven (NL); Wilma Van Es-Spiekman, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 622 days.

(21) Appl. No.: 10/535,801

(22) PCT Filed: Oct. 29, 2003

(86) PCT No.: PCT/IB03/04891

§ 371 (c)(1),
(2), (4) Date: May 23, 2005

(87) PCT Pub. No.: WO2004/048677

PCT Pub. Date: Jun. 10, 2004

(65) Prior Publication Data

US 2006/0123555 A1 Jun. 15, 2006

(30) Foreign Application Priority Data

Nov. 26, 2002 (EP) ..... 02079912

(51) Int. Cl.
*D06M 15/37* (2006.01)

(52) U.S. Cl. ..... 8/116.1; 427/302; 427/393; 427/394; 510/475; 8/185

(58) Field of Classification Search ..... 8/194, 8/116.1, 185; 427/302, 393, 394; 510/475
See application file for complete search history.

(56) References Cited

U.S. PATENT DOCUMENTS

| | | | | |
|---|---|---|---|---|
| 3,096,524 | A * | 7/1963 | Mizell | 428/121 |
| 3,539,286 | A * | 11/1970 | Bowers et al. | 8/115.59 |
| 4,269,603 | A * | 5/1981 | Worth | 8/116.4 |
| 5,532,023 | A | 7/1996 | Vogel et al. | |
| 5,885,303 | A * | 3/1999 | Payet | 8/116.4 |
| 6,596,034 | B1 * | 7/2003 | Crawford et al. | 8/115.6 |
| 2001/0001794 | A1 * | 5/2001 | Payet | 525/418 |

FOREIGN PATENT DOCUMENTS

| | | | |
|---|---|---|---|
| JP | 02127572 | A | 5/1990 |
| JP | 2001316978 | A | 11/2001 |
| WO | 200138627 | A2 | 5/2001 |

* cited by examiner

*Primary Examiner*—Gregory E Webb

(57) ABSTRACT

The invention relates to a compound to improve wrinkle resistance in fabrics, comprising: a wrinkle reducing agent, comprising at least one fusible elastomer, and a liquid carrier for carrying said agent and a salt composition for physical crosslinking said fusible elastomer. The invention also relates to a fabric provided with said wrinkle resistance improving compound. The invention further relates to a method of improving wrinkle resistance in a fabric by use of such a compound.

16 Claims, No Drawings

COMPOUND AND METHOD TO IMPROVE WRINKLE RESISTANCE IN FABRICS, AND FABRIC PROVIDED WITH SAID COMPOUND

The invention relates to a compound to improve wrinkle resistance in fabrics, comprising: a wrinkle reducing agent, comprising at least one fusible elastomer, and a liquid carrier for carrying said agent. The invention also relates to a fabric provided with said wrinkle resistance improving compound. The invention further relates to a method of improving wrinkle resistance in a fabric by use of such a compound.

In Wear Wrinkle Resistance (IWWR), as the name suggests, means the property of a set fabric, e.g. cotton, which enables it to resist formation of wrinkles, especially during wear of the fabric. IWWR can be assessed by measuring the ability of a set fabric to resist the formation of wrinkles. Wrinkle resistance is generally assessed by Wrinkle Recovery Angle (WRA) tests. A well-known standard test is the AATCC method 66-1998. Such tests assess the ability of fabric which is set in a flat state to recover this flat state after being folded, subjected to a temporary load, preferably 500 g during 60 s, and then released. The assessment is carried out by measuring the recovered angle (WRA) after a given time (commonly 5 minutes). The greater the angle, the better the recovery. Angles are measured in both the warp and the weft direction and added up to give a final result of the assessment. A perfectly elastic material would give a WRA of 360 degrees. A perfectly viscous material would give a WRA of 0 degrees.

Compounds for reducing wrinkle formation in fabrics are known. The American patent publication U.S. Pat. No. 5,532,023 discloses, for example, a wrinkle reducing composition which can be applied to fabrics. The composition comprises a wrinkle reducing agent, comprising an effective amount of silicone and an effective amount of film-forming polymer, which agent is dispersed in a liquid carrier. In particular, the disclosed composition is adapted to impart a lubricating property or increased gliding ability to fibers in fabric, particularly clothing. This gliding effect between the fibers is particularly caused by the silicone. Deformation of the clothing reduces the friction between the fibers of the clothing, which results commonly in a decreased energy dissipation at the fibers and (thus) also a relatively good and easy contra-deformation (recovery) of the fibers in the original state. However, decreasing the friction between the fibers of the clothing will also facilitate the formation of a wrinkled state of the clothing. Application of the disclosed composition on clothing leads commonly to a WRA of up to about 200 degrees.

It is an object of the invention to provide an improved compound which improves significantly wrinkle resistance in fabrics, without facilitating the formation of a wrinkled state of the fabrics.

This object of the invention is achieved by a compound as mentioned in the opening paragraph, characterized in that the compound further comprises at least one salt composition for physical crosslinking of said fusible elastomer. Crosslinking provides elastic linkages between molecular chains of said fusible polymer to prevent them from sliding past each other irreversibly, which would lead to dissipation of energy. Such junctions provide an additional source of energy for recovery. Physical crosslinking provides a relatively strong elastic binding between the chains of the fusible elastomer. In particular, cations of the salt composition form an intermediate between chains of said fusible elastomer. Thus, said cations of the salt composition provide—in combination with the fusible polymer—a relatively strong elastic binding between fibers of said fabric with a certain memory, which enables it to recover relatively easily after bending or creasing of the fibers. Application of the compound according to the invention will commonly lead to a WRA of significantly above 200 degrees. The fusible elastomers used may be e.g. polyurethanes, polybutadienes, and acrylate copolymers (of, for example, butyl acrylate and acrylic acid, preferably in a ratio of 80:20), as long as said chains of aforementioned elastomers can be linked by cations of the salt composition. The liquid carrier used in the compound of the present invention is preferably a system comprising water. Optionally, in addition to water, the carrier may comprise another liquid solvent which is well soluble in water, such as an alcohol.

Preferably, the salt composition comprises polyvalent cations. Polyvalent cations having a multiple positive charge, e.g. 2+ (zinc, calcium, magnesium) and 3+ (iron, aluminium), are in fact capable of crosslinking multiple chains of said elastomer whereby said physical crosslinks are formed. In a preferred embodiment, the salt composition comprises at least one of the following ions: zinc, calcium and borate ions.

The salt composition is preferably insoluble in the liquid carrier at room temperature and sufficiently soluble in the liquid carrier for physical crosslinking of said elastomer at a relatively high temperature. The mixing of said wrinkle reducing agent with said salt composition according to the invention will commonly have consequences for the stability of the emulsion because crosslinking (or sometimes even a change in pH as a result of the addition of the salt) can cause particles of said compound to flocculate, thereby precipitating from the solution. This problem can be solved by applying an insoluble salt composition. If the temperature of the compound is subsequently increased, the fusible elastomer will melt and the salt composition will dissolve and will finally crosslink the chains of said elastomer. Note that for effectuating a reaction (physical crosslinking) between said elastomer and ions of said salt composition it is necessary to ionize, and thus dissolve, said salt composition to a sufficient degree.

Preferably, the compound according to the invention comprises microcapsules which are provided with said salt composition, either as an aqueous solution or in a solid state. Said microcapsules are commonly stable at room temperature and prevent premature contact between said salt composition and said fusible elastomer. When the temperature of said compound has increased sufficiently, the microcapsules will deform in such a manner that the salt composition will contact said fusible elastomer. Deforming of said microcapsules may be realized, for example, through melting, dissolving, or tearing open.

In a preferred embodiment, the content of the agent in the liquid carrier is between 2 and 60% by weight, preferably between 5 and 30% by weight, more preferably substantially 12.5% by weight. Between or at these values, a good dispersion of the active in the liquid carrier can be obtained and maintained. If said percentage of 60% is (significantly) exceeded, a sticky, non-controllable dispersion is usually obtained.

In another preferred embodiment, the elastomer has a softening temperature between 50 and 100° C. in the presence of water. Easy softening of the elastomer at an increased temperature commonly results in an easy provision of the yarns of the fabric with the compound according to the invention. The viscosity of the softened compound is relatively very low, which means that the polymers do not interfere with the wrinkle removal from the fabric, e.g. during ironing of said fabric, as long as the fabric is relatively hot. When the fabric cools down, the compound according to the invention solidifies to form an elastic film around and between the yarns or individual fibers, thereby inducing a degree of elasticity in the treated fabric. This in turns improves the WRA value substantially.

Preferably, the fusible elastomer is provided with one or more effective groups, more preferably comprising of least one of the following groups: hydroxylic groups and carboxylic groups. The effective groups can be bonded to an ion, mostly a cation, thereby forming a complex of an ion and more polymer chains. The formed macromolecule is also known as an ionomer. It may be obvious to those skilled in the art to apply effective groups other than those of the two examples mentioned afore. It may therefore be clear that within the scope of the claims elastomers with other effective groups may alternatively be applied. The binding of at least two chains of an elastomer to an ion of said salt composition can be illustrated in the two following non-restrictive examples.

In the first example, two chains of a copolymer of acrylic acid are physically crosslinked by a bivalent zinc-ion:

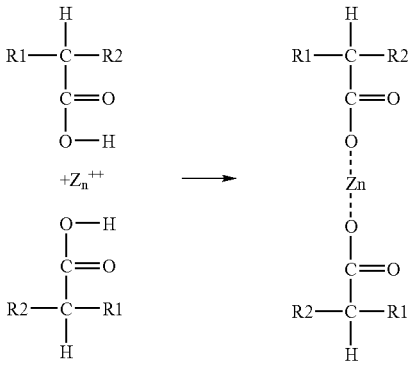

wherein R1 and R2 are parts of the chain of a molecule of the aforementioned copolymer. In this example the carboxylic groups function as effective groups for physical crosslinking. In the second example two chains of a (co)polymer provided with alcoholic groups as effective groups are bound by a borate-ion.

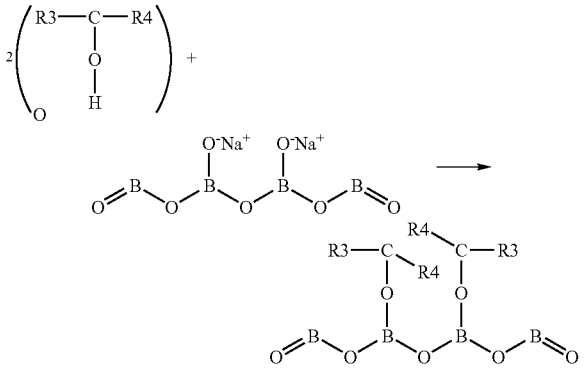

wherein R3 and R4 are parts of the chain of a molecule of the aforementioned (co)polymer. The borate ion thus functions as an intermediate for physical crosslinking of said two chains.

In a preferred embodiment, the molar ratio of (cat)ions of said salt composition to the effective groups of the fusible elastomer is substantially situated between 1:4 to 1:6, and is preferably 1:5. The molar ratio of 1:5 is in particular suited for a bivalent (cat)ion in combination with said fusible elastomer since a slight excess of polymer molecules are present compared to the added (cat)ions.

The compound is preferably provided with additives, such as a surfactant, stabilizer, perfume, anti-bacterial additives, or silicones for improving gliding between the fibers of the fabric, etc., as long as the additive does not interfere with the primary function of the polymer. The use of additives in a compound according to the invention can be very suitable when applying the compound to a fabric by means of a domestic appliance, such as an iron. The additives may also be applied during a washing cycle. However, to prevent premature flocculation of the compound according to the invention, it is not desirable to add both the salt composition and the fusible elastomer to a washing machine.

The invention also relates to a fabric provided with said wrinkle resistance improving compound. In a preferred embodiment, the compound comprises at least one ionomer, which ionomer comprises: ions, preferably polyvalent cations, and said fusible elastomer, wherein chains of said fusible elastomer are physically crosslinked by the (cat)ions. As was mentioned above, the ionomer may be created by an increase of the temperature that melts the elastomer. After cooling down the ionomer remains in the fabric as an elastic substance on and in particular between the fibers, resulting in a relatively high wrinkle resistance.

The invention further relates to a method of improving wrinkle resistance in a fabric by the use of said wrinkle resistance improving compound comprising the steps of: A) applying the compound to the fabric, B) removing the wrinkles in the fabric, and C) permitting the liquid carrier to evaporate at least partially. The amount of agent typically applied, particularly sprayed, onto the fabric is preferably from about 0.5 to about 10% by weight, more preferably from about 2 to about 5% by weight with respect to the fabric. Once an effective amount of compound has been sprayed onto the fabric, the fabric is stretched or smoothed by hand according to step B). After the effective amount of compound has been applied to the fabric and the latter has preferably been stretched, the liquid, in particular moisture, is permitted to evaporate at least substantially. The evaporation may occur both in a passive way or in an active way through an increase in the temperature of the fabric. Evaporation of the moisture is commonly relevant, as the particles of the fusible elastomer will stick together and thus form a solidified sheath around the fibres and yarns of the fabric. Furthermore, evaporation of moisture will commonly also result in stress relaxation in the yarns of the fabric. A decrease in the stored energy will maintain the fabric in its set, i.e. flat, state.

Preferably, the application of the compound to the fabric according to step A) is realized by means of a domestic appliance. Examples of such domestic appliances are a washing machine, an iron provided with a compound spraying reservoir, and other spraying devices for a compound according to the invention. In a more preferred embodiment, an iron is provided with two separate spraying reservoirs. A first reservoir can be filled with an aqueous solution of the salt composition and a second reservoir can be filled with a dispersion of the fusible elastomer. Separation of both ingredients of the compound according to the invention prevents flocculation of compound in advance. Thus, the two ingredients will contact each other after the spraying of both ingredients on said fabric. According to this embodiment, ionomers will therefore only be formed on the fabric.

In a preferred embodiment of the invention, the removal of the wrinkles in the fabric according to step B) is realized by means of an iron at an increased temperature compared with an environmental temperature. In this way step C) will commonly be applied during application of step B). Thus, the increased temperature will lead both to an accelerated evaporation of applied liquid and to a softening of the fusible elastomer. Cooling down of the fabric results commonly in an elastic protective layer formed around the stretched yarns of the fabric, wherein the layers are bound to each other by elastic bridges. Deformation of the fabric after applying the method according to the invention will temporarily lengthen said elastic bridges, which will attempt to bring the yarns to their original stretched, non-wrinkled state during a certain time.

In a final preferred embodiment, the application of the compound on the fabric according to step A) is realized in that the salt composition and the wrinkle reducing agent are applied sequentially. Sequentially adding the ingredients of the compound to said fabric may be realized, for example, by the aforementioned iron provided with two separated reservoirs. It is also possible to add one of the ingredients, e.g. the salt composition, to the fabric during a washing cycle. The fusible elastomer can be sprayed on the fabric provided with said salt afterwards. This is to prevent flocculation (crosslinking) of the ingredients before they are applied to the fabric.

The invention may be further illustrated by way of the following non-restrictive example.

EXAMPLE

A 12.5% (by weight) solution of latex of poly(butyl acrylate-co-acrylic acid) 90:10 in water was prepared (Composition A) by dilution to the required level. A 2% solution of zinc acetate dihydrate (Aldrich) was prepared in water (composition B). Composition B was then sprayed onto a piece of fabric (cotton type 407) such that the total pick-up based on fabric weight was 15%. This led to an additive pick-up of 0.3% based on dry fabric weight. After being dried in air, the fabric was sprayed with Composition A such that the total pick-up based on fabric weight was 40%. Hence the amount of polymer based on fabric weight was 5%. The ratio of zinc ions to the acrylic acid groups was 1:5 (molar equivalents). The fabric was then ironed to dryness with an iron set to a temperature suitable for cotton. After conditioning of the fabric for 24 hours, the WRA was measured according to the standard AATCC method 66-1998 for cut-out pieces of the specified size (40 mm×15 mm), in both the warp and weft directions. The average WRA value obtained from fabrics treated as above was compared with WRA measurements carried out on fabrics ironed without the application of any additives (reference value) as well as fabrics ironed after the application of 5% based on fabric weight of only poly(butyl acrylate-co-acrylic acid) 90:10.

The WRA reference for said fabric is 140°. The resulting WRA for the used poly(butyl acrylate-co-acrylic acid) latex according to composition A was 1970. However, the resulting WRA of the used poly(butyl acrylate-co-acrylic acid) latex in combination with said zinc ions according to composition B was 204°.

The invention claimed is:

1. A composition to improve wrinkle resistance in fabrics, the composition comprising:

a wrinkle reducing agent including at least one fusible elastomer having one or more effective groups for bonding to an ion;

a liquid carrier for carrying said wrinkle reducing agent; and at least one salt composition having cations for physical crosslinking of said fusible elastomer to provide elastic linkages between molecular chains of said fusible polymer, wherein the cations of the at least one salt composition in combination with said fusable elastomer provide a strong elastic binding between fibers of the fabric with a certain memory, which enables the fabric to recover relatively easily after bending or creasing of the fibers.

2. The composition according to claim 1, wherein the at least one salt composition comprises polyvalent cations having a multiple positive charge.

3. The composition according to claim 2, wherein the polyvalent cations of the at least one salt composition are selected from at least one of zinc, calcium, and borate ions.

4. The composition according to claim 1, wherein the at least one salt composition is insoluble in the liquid carrier at room temperature and sufficiently soluble in the liquid carrier at a relatively high temperature for physical crosslinking of said elastomer.

5. The composition according to claim 1, further comprising microcapsules which are stable at room temperature to prevent premature contact between said salt composition and said fusible elastomer, the microcapsules are provided with said at least one salt composition.

6. The composition according to claim 1, wherein the content of said wrinkle reducing agent in the liquid carrier is between 2 and 60% by weight.

7. The composition according to claim 1, wherein the elastomer has a softening temperature of between 50 and 100° C. in the presence of water.

8. The composition according to claim 1, wherein the fusible elastomer is provided with the one or more effective groups selected from at least one of hydroxylic groups and carboxylic groups.

9. The composition according to claim 8, wherein the molar ratio of cations of said at least one salt composition to the effective groups of the fusible elastomer is substantially situated between 1:4 to 1:6.

10. The composition according to claim 1, further comprising additives including a surfactant, stabilizer, or perfume for improving gliding between the fibers of the fabric.

11. The composition according to claim 1, wherein the physical crosslinking is between portions of said fusable elastomer.

12. The composition according to claim 8, wherein the at least one salt composition and said fusable elastomer form an ionomer as a complex of an ion and two or more polymer chains with an increase of temperature sufficient to melt said fusable elastomer.

13. The composition according to claim 1, wherein said fusable elastomer comprises a solution of poly(butyl acrylate-co-acrylic acid).

14. The composition according to claim 1, wherein said fusable elastomer comprises a solution of poly(butyl acrylate-co-acrylic acid) 90:10 in water.

15. The composition according to claim 1, wherein the at least one salt composition comprises a solution of zinc acetate dehydrate.

16. The composition according to claim 1, wherein the at least one salt composition comprises a 2% solution of zinc acetate dihydrate in water.

* * * * *